United States Patent [19]

Rader

[11] 3,930,651

[45] Jan. 6, 1976

[54] THREE DIMENSIONAL WORD GAME

[76] Inventor: James Eads Rader, R.F.D. 1, Plainfield, Vt. 05667

[22] Filed: Aug. 5, 1974

[21] Appl. No.: 494,984

[52] U.S. Cl. .. 273/135 D; 273/130 AC; 273/130 E; 273/156

[51] Int. Cl.[2] ..... A63F 3/00

[58] Field of Search..... 273/130 AC, 130 B, 130 E, 273/131 AC, 131 G, 134 AB, 135 D, 157 R, 136 R, 136 H, 136 K, 136 W, 156

[56] References Cited

UNITED STATES PATENTS

| | | | |
|---|---|---|---|
| 487,063 | 11/1892 | Bailey | 273/156 |
| 2,886,325 | 5/1959 | Long | 273/130 E |
| 3,427,028 | 2/1969 | Abrahamsen | 273/135 D |
| 3,771,795 | 11/1973 | Flanigen | 273/157 R |

FOREIGN PATENTS OR APPLICATIONS

| | | | |
|---|---|---|---|
| 699,546 | 3/1953 | United Kingdom | 273/130 AC |

*Primary Examiner*—Anton O. Oechsle
*Assistant Examiner*—Joseph R. Taylor
*Attorney, Agent, or Firm*—Perry J. Saidman

[57] ABSTRACT

A three-dimensional word game comprising a 3×3×3 cube for receiving letter pieces, there being 26 letter-receiving spaces disposed on the surface of the cube. One letter of the alphabet may be associated with each of 26 letter pieces. In playing the game, players take turns placing one or more letter pieces onto the cube. Words are spelled out by tracing a path between consecutively adjacent letter pieces.

5 Claims, 5 Drawing Figures

FIG. 4
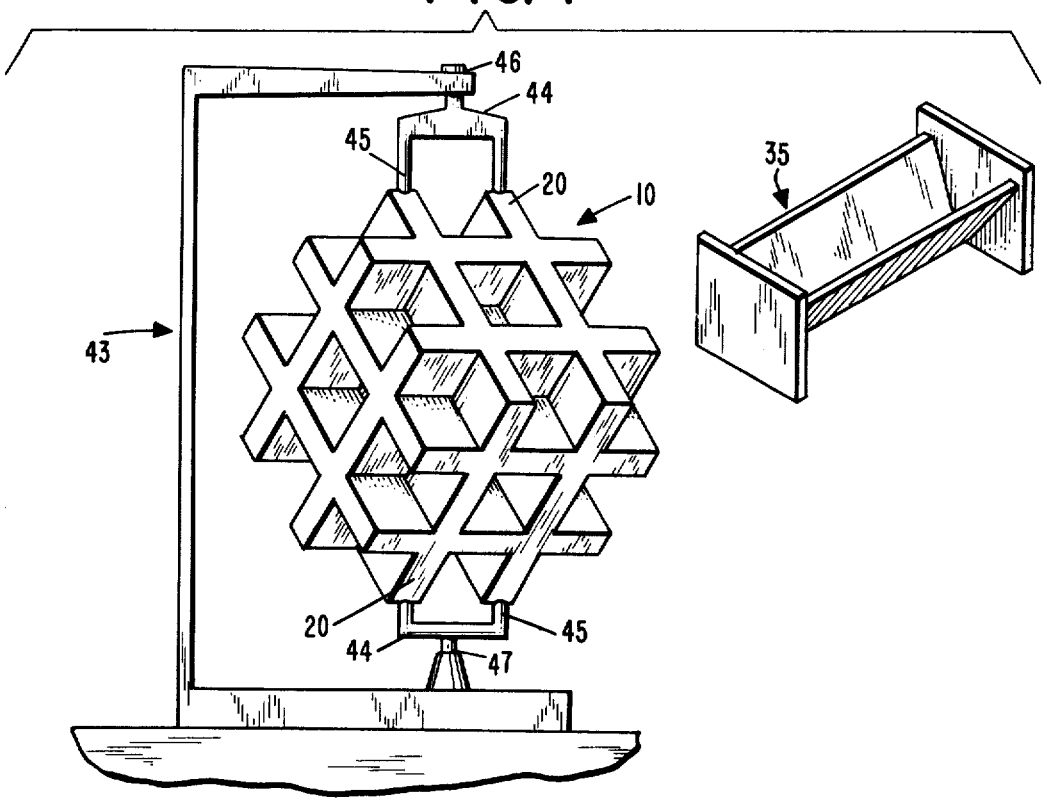
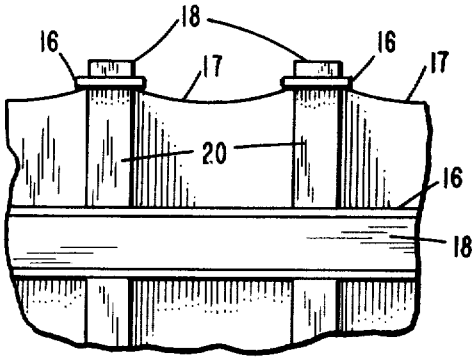
FIG. 5

THREE DIMENSIONAL WORD GAME

BACKGROUND OF THE INVENTION

1. Field of the Invention

This invention relates to games, and more particularly to a three-dimensional word game apparatus.

2. Description of the Prior Art

Word games have been provided of a "crossword" nature, to be played on paper or on a two-dimensional board or surface. Crossword-type games have also been provided which employ cubes as playing pieces to spell out words in a crossword fashion on a flat surface, using only the upward-facing face of each playing piece. In each of these instances, the game is played in a flat plane and the spelling out of words involves only crossword-type, vertical or horizontal straight-line relationships between playing pieces.

Three-dimensional crossword puzzles are known (see, e.g., U.S. Pat. No. 2,886,325 to Long) which utilize cubical blocks having different letters and symbols on the different faces of a given block. Complexity is derived from the fact that a given block is a part of six different crossword puzzle solutions, two in each plane. However, within each plane, the spelling out of words is still accomplished in the same vertical or horizontal crossword fashion described above.

The present invention goes beyond prior art word games in providing for the playing of letters or letter pieces, not onto a flat surface, but onto the surface of a three-dimensional closed solid. Further, the paths involved in the spelling out of words are not straight-line paths, but are circuitous and often complex paths in three dimensions about the closed surface. Relationships between playing pieces derive richness from the complex topological relationships between areas on the three-dimensional closed surface. A given letter piece may be used not just once, but twice or more, in the spelling of a word or phrase if a player has enough acumen to manage the arrangement of letter pieces to provide for a looping, continuous path between the necessary letters.

Fruitful comparison may be made to two features of the game of chess that help to make it such a richly complex game:

1. Chess is played in a limited, contained universe (a board of 64 squares).

2. Within that universe, relationships between playing pieces are very complex.

This results in almost unlimited possibilities, too great for enumeration or for learning by any one person. The possibilities for strategy are likewise practically unlimited.

In a somewhat similar fashion, the game of the present invention:

1. is played in a limited, contained universe (26 playing positions) which, in addition, closes on itself and is everywhere continuous with itself (i.e., it has no edges as a board does); and 2. provides complex relationships between playing positions and, thus, between playing pieces when they have been played.

Additionally, the present invention is a word game (thus adding lexicological complexities and possibilities) and it is played in three dimensions. It can therefore be said that the game of the present invention introduces a new dimension and a new order of strategic possibilities heretofore unknown in the world of word games.

OBJECTS AND SUMMARY OF THE INVENTION

It is therefore an object of the present invention to provide a three-dimensional word game which includes a three-dimensional solid having spaces for receiving letter pieces which may be placed around the surface of the three-dimensional solid for the spelling out of words.

Another object of the present invention is to provide a game of the type described in which the three-dimensional solid comprises a 3×3×3 cube, whereby the number of spaces for receiving letter pieces corresponds to the number of letters in the English alphabet.

It is a further object of the present invention to provide a word game of the type described in which words may be spelled out by beginning at one letter piece and tracing a path through consecutively adjacent letter pieces, which path may loop back on itself and pass through a given letter piece more than once.

It is a more specific object of the present invention to provide a word game of the type described which comprises a three-dimensional solid, letter pieces for placement on the three-dimensional solid, and a stand on which the three-dimensional solid is held, whereby handling of the letter pieces and three-dimensional solid by a player is facilitated.

An additional object of the present invention is to provide a method of playing a three-dimensional word game.

Briefly, in accordance with the present invention, a three-dimensional word game is provided which comprises in the preferred form a 3×3×3 cube for receiving letter pieces, there being 26 letter-receiving spaces disposed on the surface of the cube. In playing the game, players take turns placing one or more letter pieces onto the cube. Words are formed by tracing a path between consecutively adjacent letter pieces.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 4 is a perspective view of further apparatus which may be utilized in accordance with the present invention; and FIG. 5 is a side view illustrating an embodiment of the letter piece retaining means of the present invention.

DETAILED DESCRIPTION OF THE PREFERRED EMBODIMENT

Figure 1:
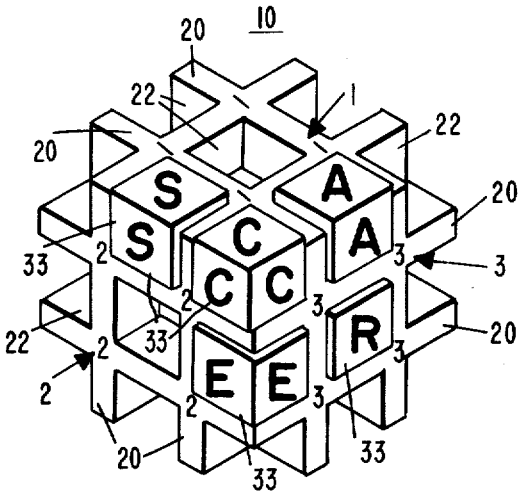
FIG. 1 is a perspective view of the three-dimensional game apparatus constructed in accordance with the present invention.

Referring now to FIG. 1, which is a perspective view of an apparatus constructed in accordance with the present invention, there is illustrated a three-dimensional solid 10 having means for receiving and engaging letter pieces 33. The three-dimensional solid 10 which receives the letter pieces 33 is hereinafter referred to as the rack 10. In the preferred embodiment, the rack 10 is a cubical solid divided into a 3×3×3 matrix. Therefore, the rack 10 is composed of 3×3×3, or twenty-seven, cubicles or compartments 22. However, the central one of the twenty-seven cubicles is totally surrounded by the cubicles having at least one face exposed on the surface of the rack 10. Therefore, there are 26 "exposed" cubicles 22 comprising the rack 10. It should be noted that the number 26 is also the number of letters in the English alphabet. Therefore, one letter of the alphabet may be associated with each of 26 letter pieces 33, and, during the playing of a game, one of the letter pieces 33 may be played into each of the 26 exposed cubicles 22.

In the preferred embodiment, letter pieces 33 are cubical in shape and of proper size to fit into and be engaged by any of the cubicles 22. Letter pieces 33 are 26 in number, each letter piece having one letter of the alphabet associated with it and printed, embossed, or otherwise inscribed on each of its six faces. Appropriate letter scores may also be inscribed along with the letters. On three mutually adjacent faces of a letter piece 33, the letter (and letter score) may be inscribed in one color (for example, black), while on the other three faces it may be inscribed in a contrasting color (for example, red), so that a letter piece 33 may be placed onto the rack 10 with the letter exposed in either of the two colors.

In the embodiment of FIG. 1, the rack 10 is formed of three pairs of parallel walls 20. Each pair of parallel walls 20 perpendicularly intersects the other two pairs of parallel walls 20 such that the edges of the intersecting walls 20 define a cubical outline, six cubical faces, and 26 recesses or cubicles 22 in addition to the one inaccessible cubicle at the center thereof.

Many suitable means for securing letter pieces 33 into the cubicles 22 will suggest themselves to one skilled in the art. For example, the cubicles 22 may be equipped with slotted pegs and the letter pieces 33 with holes for engagement with the pegs. Alternatively, the cubicles 22 may be equipped with one or morer magnets, and the letter pieces 33 may be manufactured of a suitable metal or magnetic material.

FIG. 5 is a partial side view of the rack 10 which shows another and alternative letter piece retaining means 16 and 18 placed only on three edges of walls 20 for the sake of clarity. The rack 10 may be fitted together of slotted pieces which may be constructed of wood, plastic, or other suitable material. On each face of the rack, the edges of at least two walls 20 may be fitted with strips or bands 16 of rubber, or a similar suitable elastic material, which overlap the edges of the cubicles 22 and act as "grippers" to secure the letter pieces 33 (not shown in this view) into the cubicles. Strips of wood, metal, or other suitable material 18 may be laid over elastic bands 16 to secure them. The number of each face of the rack 10 (numbered from 1 to 6 in a standard but arbitrary order) may be stamped or otherwise inscribed on these overlaid strips, as indicated in FIG. 1. Also, on each face, the edges of two walls 20 may be fitted with finger notches 17 to facilitate the removal of letter pieces from the cubicles. Alternatively, if the rack 10 is made of plastic or similar material, it may be molded in one piece. In this case, the grippers 16 as well as the finger notches 17 may be molded as an integral part of the rack, thus obviating the need for the overlaid strips 18. Many other well-known materials may be used to provide a rack 10 and letter pieces 33 constructed in accordance with the above teachings. Indeed, the above description is intended to suggest to those skilled in the art that many variations may be utilized in providing an apparatus constructed in accordance with the above teachings.

Figure 2:
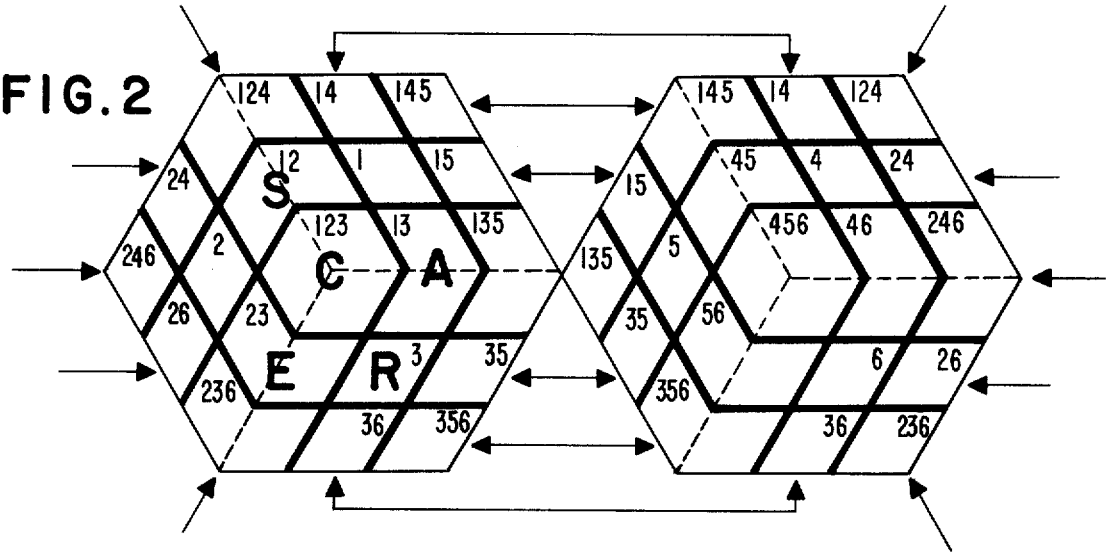
FIGS. 2 and 3 illustrate a map or diagram of the apparatus for use in facilitating and recording the play of the game.
Figure 3:
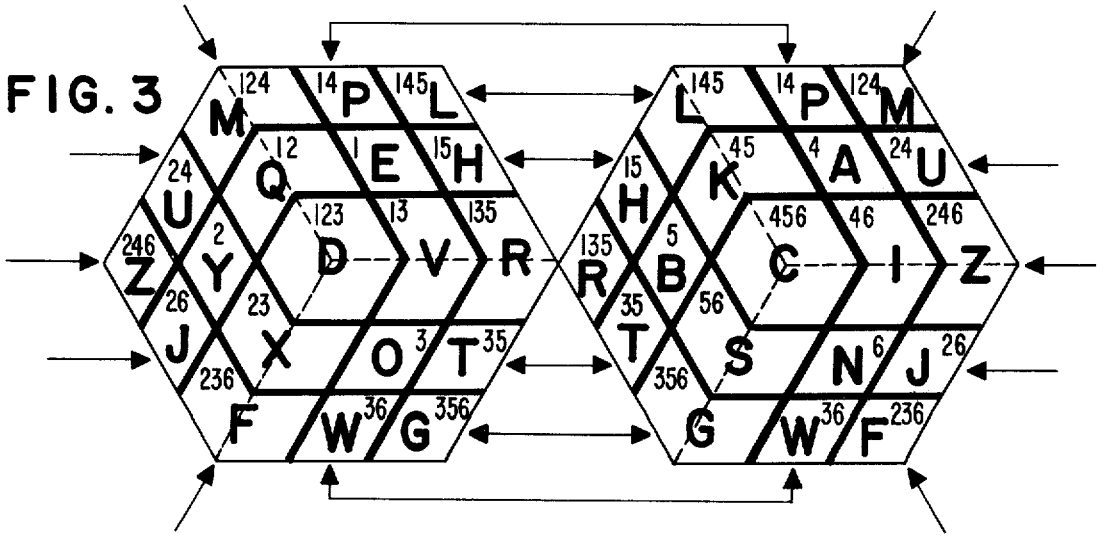

FIGS. 2 and 3 illustrate a map or diagram of the rack 10 that may be used to record and facilitate the play of the game. FIG. 2 is a two-dimensional representation of the three-dimensional rack 10 of FIG. 1, with the positions of the five letter pieces 33 recorded as shown.

It should be noted that the diagram of FIGS. 2 and 3 may be used as a substitute for the rack 10 at FIG. 1 in playing games in accordance with the present invention and thus the diagram may be regarded as an alternative form of the rack 10, as well as an important aid in the playing of the game with the game apparatus depicted in FIG. 1.

The diagram is seen to comprise a map or projection of two halves of rack 10 as it is rotated about an axis running between the center of the edge between faces 1 and 4 and the center of the edge between faces 3 and 6 of the rack 10. Arrows are included in the diagram to facilitate the visual connection of the parts of any cubicle that appears in both halves of the diagram.

Communication during play and recording of play are further facilitated by a standard system for designating the various cubicles 22 on the rack 10. These designations are indicated on the diagrams of FIGS. 2 and 3 and can be explained as follows. As noted previously, the six faces of the rack 10 are arbitrarily but standardly numbered 1 through 6. The cubicle at the center of each face is designated by the number of the face. In other words, cubicle 1 refers to the cubicle at the center of face 1. An edge cubicle is identified by a two-digit number whose digits indicate the two faces of the rack 10 onto which it opens. For example, cubicle 12 is the cubicle which opens onto both face 1 and face 2. Similarly, cubicle 23 is the cubicle at the intersection of faces 2 and 3. A similar notation is used for corner cubicles in which each cubicle is identified by a three-digit number. For example, cubicle 124 is the cubicle at the upper left corner in FIG. 1 (or 2 or 3) which is defined by the intersection of faces 1, 2, and 4.

In order to further explain the organization, construction, and utilization of the present invention, the concept of "consecutively adjacent," which is important in the spelling out of words in the present invention, will now be explained. Two letter pieces are said to be "adjacent" if any of their respective exposed faces adjoin either side-to-side or corner-to-corner when they have been played onto the rack 10. By "consecutively" is meant that, in order for a word to be spelled out, its first letter must be adjacent to its second, its second must be adjacent to its third, and so on. (Under this concept, a letter piece is considered to be adjacent to itself, so that double letters are always possible.) These concepts will be illustrated further with reference to FIGS. 1 and 2.

It should be apparent even to the casual observer that the five letter pieces illustrated in FIGS. 1 and 2, played as shown, may be used to spell out the word "scare." The path begins at S and proceeds through the other four letters by side-to-side, crossword-type adjacency. However, it may not be so obvious that a word like "creases" can also be spelled out using the same five letter pieces played into the same cubicles. To trace the path involved, begin with C and move to R; note that the two letter pieces are adjacent corner-to-corner on face 3 of the rack. Moving on, R is adjacent to E side-to-side, and E and A are adjacent corner-to-corner on face 3. A and S are adjacent corner-to-corner on face 1, while S and E are adjacent corner-to-corner on face 2. Note that this path is rather circuitous, crossing itself, looping back on itself (for example, passing through E twice), and reversing itself (between E and S).

The versatility and richness of the present invention are illustrated by the fact that, using the arrangement of only five letter pieces illustrated in FIGS. 1 and 2, at least one hundred and six words can be spelled out in accordance with the above teachings. These words are listed in TABLE I.

TABLE I

| | | |
|---|---|---|
| 1. a | 24. assess | 47. cess |
| 2. access | 25. assesses | 48. cesses |
| 3. accesses | 26. caeca | 49. crass |
| 4. ace | 27. car | 50. crease |
| 5. aces | 28. caracara | 51. creaser |
| 6. acre | 29. caracaras | 52. creases |
| 7. acres | 30. care | 53. creese |
| 8. ar | 31. career | 54. creeses |
| 9. arc | 32. cares | 55. cress |
| 10. arcs | 33. caress | 56. cresses |
| 11. are | 34. caresses | 57. ear |
| 12. area | 35. cascara | 58. ease |
| 13. areae | 36. cascaras | 59. eases |
| 14. areas | 37. case | 60. er |
| 15. areca | 38. cases | 61. era |
| 16. arecas | 39. casease | 62. eras |
| 17. ares | 40. caseases | 63. erase |
| 18. arras | 41. cease | 64. eraser |
| 19. arrases | 42. ceases | 65. erases |
| 20. arrear | 43. ceca | 66. ere |
| 21. as | 44. cee | 67. err |
| 22. ass | 45. cere | 68. ess |
| 23. asses | 46. ceres | 69. esses |
| 70. race | 82. recesses | 95. sea |
| 71. racer | 83. sac | 96. sear |
| 72. races | 84. sacra | 97. seas |
| 73. rare | 85. sacs | 98. see |
| 74. rarer | 86. sass | 99. seer |
| 75. rase | 87. sasses | 100. seeress |
| 76. rases | 88. scar | 101. seeresses |
| 77. re | 89. scarce | 102. sees |
| 78. rear | 90. scarcer | 103. ser |
| 79. reassess | 91. scare | 104. sere |
| 80. reassesses | 92. scares | 105. seres |
| 81. recess | 93. scree | 106. sera |
| | 94. screes | |

Many different sets of rules and competitive strategies may be developed for a game played in accordance with the above principles. For illustrative purposes, consider the following set of possible rules and procedures for a game played with the game apparatus constructed in accordance with the present invention:

1. The game begins with a blind drawing—that is, each player draws one letter piece, without looking. The letter a player draws is called that player's "draw"; only he will be permitted to use his draw in forming words. All the letter pieces remaining after the drawing constitute the "pot"; these letter pieces will be available to all players to select and play onto the rack and, once they have been played, to be used in forming words regardless of who played them onto the rack.
2. Play proceeds in alphabetical order of the players' draws, with the player whose draw is nearest the beginning of the alphabet going first.
3. At each turn, a player plays one letter piece onto the rack. He may either:
   a. Play his draw (if he has not done so previously) with red faces only exposed; or
   b. Select any letter piece from the pot and play it with black faces only exposed.
4. When all 26 letter pieces have been played onto the rack, players have three additional minutes to consider what words they can spell out with the letter pieces available to them. Then each player selects the single longest word he can spell out and writes it down.
5. The player with the longest word wins.

Many alternative rules can be suggested. For example, scoring (rules 4 and 5) may be based on a total of letter scores rather than on word length. Alternatively, scoring may be based on the number of words a player can spell out rather than on a single long or high-scoring word. If scoring is based on a total of letter scores, the nature of the draw (rule 1) may be changed so that all players may use all draws with the exception that the use of one's own draw in a word entitles a player to an extra letter or word value (for example, double score).

Returning to the illustrative rules as originally outlined above, let us consider the beginning of a hypothetical game between two players. The players respectively draw letter pieces A and C, thus becoming "Player No. 1" and "Player No. 2," respectively. Player No. 1 goes first and plays his draw (A) into the edge cubicle designated 13. Player No. 2 decides to play his draw also; he plays letter piece C into corner cubicle 123. In standard notation, this first round of play may be summed up as follows:

1. A13, C123

In round two, Player No. 1 selects letter piece S from the pot and plays it into edge cubicle 12. Player No. 2 selects E from the pot and plays it into edge cubicle 23. Beginning the third round of play, Player No. 1 selects R and plays it into face cubicle 3. Now, after 2 ½ rounds of play, the record of play would be as follows:

1. A13, C123
2. S12, E23
3. R3

The resulting arrangement of the five letter pieces thus played is the same as that illustrated in FIGS. 1 and 2. Reexamination of TABLE I in the light of this hypothetical game shows that, because of the exemplary rule about draws (rule 1), some words (e.g., "erases") can be spelled out only by Player No. 1, while other words (e.g., "recesses") can be spelled out only by Player No. 2, and still other words (e.g., "seeress") can be spelled out by either player. Yet a fourth group of words (e.g., "acres") cannot be spelled out by either player.

Let us now consider some strategy options open to Player No. 2 at this point. If he has been following his opponent's play closely, he may see that the longest word Player No. 1 can spell out at this point is "reassesses." He may also notice that, if Player No. 1 can play letter piece M into cubicle 2, he may be able to go on to form the longer word "reassessment." However, since cubicle 2 is the only empty cubicle adjacent to both S and E, Player No. 2 may effectively block Player No. 1 from the longer word merely by playing any letter piece other than M into cubicle 2.

In deciding what letter piece to play into cubicle 2, Player No. 2 will want to consider offensive as well as defensive considerations. For example, if he were to play letter piece X into that cubicle, he would enable himself to spell out the word "excesses." Subsequently, if he could manage to play I at 24 and V at 26, he would be able to spell out "excessive."

Other types of games to be played with apparatus constructed in accordance with this invention include a game in which the 26 letter pieces are placed onto the rack at random and then all players have a given timed period to write down as many words as possible that can be spelled out on the rack. The player with the greatest number of permissible words would win.

As shown in the discussion of FIG. 1 above, an arrangement of only five letter pieces may yield more than 100 words. It has been shown that a random arrangement of all 26 letter pieces yields a number of words on the order of 200.

Yet another game, which may be competitive or may be played solitaire, involves trying to devise an arrangement of the letter pieces that will permit the spelling out of a given long word or phrase. It has been shown that, with careful planning and patience, very long words and phrases can be spelled out on the rack. For example, 12 letter pieces can be arranged on the rack so as to permit the spelling out of the 28 letter word, "antidisestablishmentarianism." FIG. 3 shows an arrangement of the 26 letter pieces which may be used to spell out the 37 letter sentence, "The quick brown fox jumped over the lazy dogs," which uses all 26 letters of the alphabet.

However, it should be noted that not all words can be spelled out irrespective of the degree of planning, skill and patience of a player. Among the impossiblee words is "pneumoultramicroscopicsilicovolcanoconiosis," which is reputedly the longest word in the English language. To confirm that this word cannot be spelled out on the rack, note that ten different letter pieces would have to be adjacent to the letter piece O. It is noted that in the present embodiment no more than eight cubicles (and thus no more than eight letter pieces) can be adjacent to any one cubicle (or played letter piece) on the rack.

Calculations indicate that utilizing 26 different letter pieces will yield as many as seven septillion distinctly different arrangements ("distinctly" excluding arrangements obtained by rotation or reflection). Many more variations can be achieved by permitting the use of more than 26 letter pieces 33, as by providing duplicates of certain letters, or by employing a rack based on a matrix larger than 3×3×3.

Referring now to FIG. 4, there is illustrated additional equipment which may be utilized in conjunction with the above-described embodiments. Two stands 35 and 43 are illustrated which may be used to support the rack 10. The stand 35 is trough-shaped, preferably made of a transparent material, and of proper size to receive an edge of the rack 10. The stand 43 is illustrated holding the rack 10. A pair of arms 44 (at least one of them preferably spring-loaded) grasp the walls 20 of the rack 10, and pins 45 projecting from the arms 44 fit into holes suitably formed in the corners of the walls 20. The arms 44 are pivoted as at 46 and 47 so that the rack 10 may be rotated about a vertical axis. It is apparent that other forms of stands may also be provided for the apparatus of FIG. 1.

The methodology of the present invention may be described as providing a three-dimensional surface having means thereon for receiving letter pieces arranged preferably in a matrix, and placing letter pieces in locations on the three-dimensional solid in order to be able to spell out a word by tracing a path between consecutively adjacent letter pieces. A record of play may be provided by recording letters on a diagram of the solid or rack or by listing cubicle designations and letters. Many forms of rules and scoring systems may be developed.

If desired, the rack 10 need not be cubical, and other arrangements than the preferred 3×3×3 matrix may be utilized. Also, in the preferred form, the set of letter pieces 33 includes one letter piece corresponding to each letter of the English alphabet. However, other sets of letter pieces may be utilized. Also, the letter pieces may have shapes other than cubical in accordance with the design of the rack onto which they are to be played. Alternatively, letter pieces might be dispensed with altogether and letters written directly onto the three-dimensional solid, as, for example, with chalk.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. Word game apparatus comprising, in combination: a three-dimensional cube including means located on each of the six faces thereof forming at least 26 defined locations for receiving letter pieces, 26 cubical letter pieces each of which has a unique letter of the English alphabet associated therewith and inscribed on each of the six faces thereof, said letter pieces interacting with said cube such that said letter pieces may be placed at said defined locations on said three-dimensional cube, and words may be spelled out by tracing a path through consecutively adjacent letter pieces on said three-dimensional cube.

2. Apparatus according to claim 1 in which said cube comprises a 3×3×3 cube, whereby the number of said letter-receiving locations on the surface of said cube is the same as the number of letters in the English alphabet.

3. Apparatus according to claim 3 wherein said cube is formed by three intersecting pairs of parallel walls, said walls defining a cubical outline and twenty-six cubical recesses for receiving letter pieces.

4. Apparatus according to claim 3 further comprising a stand having a pair of arms for holding said cube and allowing it to be rotated about an axis said arms each comprising a U-shaped member the ends of which are connected to one of said pairs of parallel walls, each of said arms being connected to the same pair of parallel walls but disposed 180° apart from one another.

5. Apparatus according to claim 3, wherein each of said letter pieces is colored in two colors, three mutually orthogonal and contacting faces of each cubical piece being in one color, the remaining three mutually orthogonal and contacting faces being in the other of said two colors.

* * * * *